US005473843A

United States Patent [19]

LaRoche et al.

[11] Patent Number: 5,473,843

[45] Date of Patent: *Dec. 12, 1995

[54] SHOWER ENCLOSURE

[75] Inventors: Joël A. LaRoche; William J. Critchley; Steve G. Mardero, all of Winnipeg, Canada

[73] Assignee: Fiat Products Ltd., Winnipeg, Canada

[ * ] Notice: The term of this patent shall not extend beyond the expiration date of Pat. No. 5,311,707.

[21] Appl. No.: 236,101

[22] Filed: May 2, 1994

Related U.S. Application Data

[63] Continuation-in-part of Ser. No. 11,240, Jan. 29, 1993, Pat. No. 5,311,707.

[51] Int. Cl.[6] ..... A47K 3/16

[52] U.S. Cl. ..... 52/35; 4/584; 4/612; 4/614

[58] Field of Search ..... 52/34, 35; 4/612–614, 4/583, 584

[56] References Cited

U.S. PATENT DOCUMENTS

| | | | |
|---|---|---|---|
| 1,366,955 | 2/1921 | Schneible . | |
| 2,858,987 | 1/1975 | Kleinbans . | |
| 3,149,186 | 1/1961 | Wood . | |
| 3,479,778 | 11/1969 | Johnson . | |
| 3,835,480 | 9/1974 | Harding . | |
| 3,858,987 | 1/1975 | Kleinhans | 403/2 |
| 4,080,710 | 3/1978 | Hess . | |
| 4,109,426 | 8/1978 | Dobija . | |
| 4,316,295 | 2/1982 | Whitney . | |
| 4,365,368 | 12/1982 | Boggs . | |
| 4,384,377 | 5/1983 | Calvert . | |
| 4,471,501 | 9/1984 | Heymann . | |
| 4,553,276 | 11/1985 | Paradis . | |
| 4,578,832 | 4/1986 | Primucci . | |
| 4,671,026 | 6/1987 | Wissinger . | |
| 4,691,392 | 9/1987 | Whitney . | |
| 4,817,344 | 2/1990 | Wissinger . | |
| 4,901,380 | 2/1990 | Smith . | |
| 4,987,619 | 2/1991 | Smith . | |
| 5,311,707 | 5/1994 | LaRoche et al. | 52/35 |

FOREIGN PATENT DOCUMENTS

| | | |
|---|---|---|
| 1157602 | 4/1985 | Canada . |

*Primary Examiner*—Carl D. Friedman
*Assistant Examiner*—Beth A. Aubrey
*Attorney, Agent, or Firm*—Adrian D. Battison; Murray E. Thrift

[57] ABSTRACT

A joint between an upper wall part and a lower wall part of a modular tub/shower unit includes a recessed band adjacent to but spaced from the lowermost edge of the upper wall part. A further band is recessed at the uppermost edge of the lower wall part with the vertical height of that band being greater than the vertical height of the recessed band in the upper wall part and greater than a band at the lowermost edge which is not recessed, The lowermost band of the upper wall part is then adhesively attached to the uppermost edge and a part of the recessed band of the part by a double sided adhesive tape the covering of which is pulled through the gap between these parts. The adhesive tape provides the only sealant necessary for waterproofing the joint and provides the only structural strength necessary. The groove above the lowermost band of the upper wall part allows the upper wall part to be maneuvered into the required position by finger engagement into the groove. The recessed bands adjacent the upper and lower edges of the parts provide stiffening strength.

24 Claims, 3 Drawing Sheets

SHOWER ENCLOSURE

This invention is a Continuation-in-Part application of U.S. application, Ser. No: 011,240, filed Jan. 29th, 1993 and now issued U.S. Pat. No. 5,311,707 on May 17th. 1994.

The invention relates to a shower enclosure and particularly but not exclusively to a modular tub, tub surround and shower enclosure which is formed in three separate pieces, separated by horizontal joints, the invention being directed particularly to the lap joint formed between the parts of the shower enclosure.

It is well known in the manufacture of bathroom fittings to manufacture a modular tub/shower unit which includes a tub portion at the bottom, a rear wall which is integral with the tub portion and extends upwardly therefrom and two side walls which are again integral with the tub portion and extend upwardly therefrom at each end of the tub. At the top of the rear and side walls is provided a top wall again as an integral construction. This allows the whole structure to be inserted into the cavity of a wall to form a completely waterproof surround into which a bather can step to use the tub or to shower with the water falling into the tub. The fully enclosed waterproof structure is highly advantageous in that it prevents the escape of water into the wall cavity despite the shower spraying water onto the surrounding walls.

In initial installation of such a modular tub/shower arrangement in a new building, the modular unit can be brought into place at an early stage in the construction of the walls so that it is possible to maneuver the relatively large and cumbersome structure through the building without dismantling doors, walls, or the like. However in a renovation project, often the walls, doors, stairways and the like are already constructed and it is difficult to the transport the modular unit as a single construction through the building to the required location.

It has become accepted, therefore, that manufacturers of this type of construction will manufacture both the single piece unit for a new installation and a three piece unit which is manufactured for renovation projects. The three piece unit is divided by horizontal joint lines to form a top piece which includes a top wall, the rear wall and two side walls; a center piece which simply includes the rear wall and two side walls; and a bottom piece which includes the tub structure and a small portion of the rear and side walls. Generally, the center piece is of greater height than the top and bottom pieces since this piece is more maneuverable.

One problem which has always arisen with products of this type is that of forming a suitable joint between the top, middle and bottom pieces. Various different styles of joint have been used including butt joints and lap joints although in many cases additional connecting elements are positioned rearwardly of the wall to clamp the wall pieces together; but these are disadvantageous in that it is necessary to access these rear coupling elements.

One example of a lap joint of this type is shown in U.S. Pat. No. 4,578,832 (Primucci) which includes a lap joint section with an upper part diverted outwardly to engage over the lower part. An additional coupling element is positioned between the parts to help maintain them attached. Fastening blocks are mounted on the outside surface to assist in clamping the pieces together.

A further example is shown in U.S. Pat. No. 4,080,710 (Hess). This discloses effectively a butt joint in which the lower part includes a rear leg which is turned upwardly behind the butt joint to prevent the escape of moisture. Two flanges at the butt joint are then clamped together by fasteners.

SUMMARY OF THE INVENTION.

It is one object of the present invention to provide an improved joint system for a modular tub/shower of the above type.

According to the invention there is provided a shower enclosure comprising a wall assembly including a rear wall and at least one side wall, said wall assembly being divided at a horizontal joint into an upper wall part and a lower wall part for separate transportation into an installation location and for subsequent connection together at the horizontal joint to form the complete wall assembly, each of the upper wall part and the lower wall part including a respective portion of the rear wall and of the at least one side wall, the wall assembly having an inner surface facing inwardly and forwardly and an outer surface facing outwardly and rearwardly, the lower wall part having an upper most edge at the horizontal joint and the upper wall having a lowermost edge at the horizontal joint, and lap joint means defining a lap joint between the upper wall part and the lower wall part at the horizontal joint, said lap joint means comprising a horizontal recessed band defined in the upper wall part adjacent to but spaced from the lowermost edge thereof and having a base of the recessed band displaced outwardly and a bottom edge of the recessed band turned inwardly from the base, a first horizontal band portion of the upper wall part connected to the bottom edge of the recessed band and thus extending between the recessed band and the lowermost edge, which is displaced inwardly relative to the base of the recessed band, a portion of the upper wall part adjacent to and above the recessed band which is displaced inwardly relative to the base of the recessed band, a second horizontal band portion of the lower wall part at the uppermost edge thereof which is displaced outwardly relative to the first horizontal band portion, the second horizontal band portion being overlapped with the first horizontal band portion to lie outwardly thereof with the uppermost edge in contact with the outer surface of the bottom edge of the recessed band.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
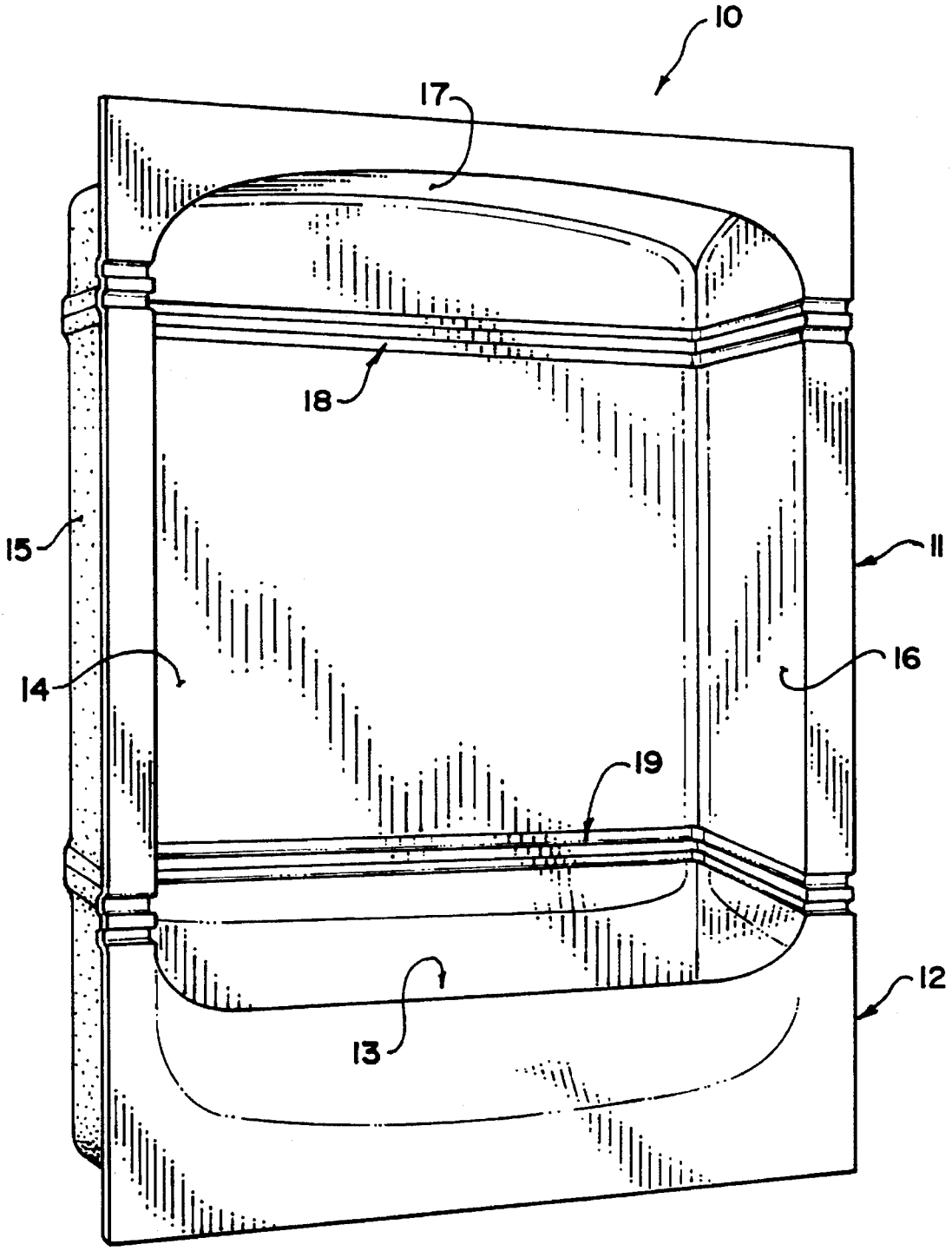
FIG. 1 is an isometric view of an assembled modular tub/shower unit according to the present invention.

A modular tub/shower unit is shown in FIG. 1 and comprises generally a top part 10, a center part 11 and a bottom part 12. The completed unit includes a bottom tub section 13 together with a rear wall 14, a first side wall 15 and a second side wall 16. At the top part is also a top wall 17. In the completely assembled unit, the tub and walls are effectively integral so as to prevent the escape of water around the tub and between the walls.

However for the manufacture of a renovation project, the tub/shower unit is manufactured in the three separate pieces 10, 11 and 12 connected together at joint lines 18 and 19.

In the examples shown, the tub/shower unit is manufactured from an acrylic material 20 which forms an inside layer and this is covered on the outside by a mat 21 of a glass fiber reinforced resin material in conventional manner. The technique for manufacturing includes initially the vacuum forming the acrylic layer to form a substantially rigid structure of the required shape following which the acrylic layer is reinforced by the application onto the outside surface of the resin and chopped fibers to form the glass fiber reinforcement.

These techniques of manufacture and the general construction of the modular tub/shower unit are well known, the improvement of the present invention relating to the construction of the joint which is shown schematically in FIG. 1 but is shown in more detail in FIGS. 2 through 5.

Figure 5:
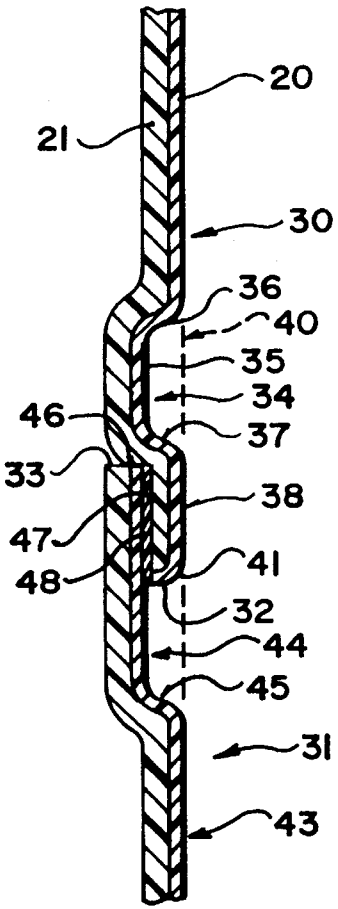
FIG. 5 is a cross-sectional view similar to that of FIG. 2 showing the finished joint.

Referring firstly to the finished joint structure shown in FIG. 5, the joint includes an upper wall part generally indicated at 30 and a lower wall part generally indicated at 31. It will be appreciated that the joints 18 and 19 are effectively identical so the joint shown in FIG. 5 constitutes one of those joints. The wall parts 30 and 31 and therefore are simply generically shown for purposes only of describing the joint.

The upper wall part 30 includes a lowermost edge 32 and the lower wall part 31 includes an uppermost edge 33. At a positioned spaced from the lowermost edge 32, the upper wall part includes a recessed horizontal band 34 including a base 35, an upper edge 36 and a lower edge 37. The recess is formed in both the inner layer 20 and the rear or outer reinforcing layer and has a depth approximately equal to the total depth of those two layers. The recessed band thus forms a hollow recess on the inner surface and a rib on the outer surface.

Between the lower edge 37 of the recessed band and the lowermost edge 32 is provided a first horizontal band 38 which in the example shown has a vertical height substantially equal to that of the base of the recess 34. The inside surface of the first horizontal band 38 lies in a common vertical plane with the main portion of the upper wall part 30 so that the recess is recessed from that common vertical plane indicated at 40. The lowermost edge 32 is formed by a convex curved part 41 of the inner surface and is defined by a portion of the inner layer 20 which is curved through 90° so as to terminate immediately adjacent the lower wall part 31.

The lower wall part 31 includes a main wall portion 43 and a second recessed band 44 which commences at a lower edge 45 and extends therefrom upwardly to the uppermost edge 33. The vertical height of the band 44 is greater than that of the first horizontal band 38 by a distance approximately equal to the vertical height of the recessed band 34. The amount of the recess of the band 44 relative to the vertical surface of the main portion 43 is substantially equal to the amount of recess to the recessed band 34. The outside surface of the first band 38 and the outside surface of the bottom edge 37 are both machined as indicated at 46, 47 to form flat surfaces at right angles to accurately receive the inside surface of the band 44 and the uppermost edge 33. Between the outside surface of the band 38 and the inside surface of the band 44 is provided a double sided adhesive tape 48 which bonds together those two surfaces in fixed position.

In the finished joint, the double sided adhesive tape constitutes the only sealing means to prevent the escape of moisture. Thus there is no need for additional silicone or similar type sealant beads to be added since moisture will tend to run down the upper wall part and is limited in its ability to move upwardly through the lap joint and is prevented from passing through that lap joint by the strong adhesive effect provided by the double sided adhesive tape.

In addition the double sided adhesive tape and the interconnection at the lap joint constitute the only structural members providing the interconnection at the joint. Thus there is no necessity for additional coupling blocks or clamping elements which are located outside the structure, although these can be provided if desired for increased structural stability.

The recessed band 34 provides an upper edge 36 which allows a user to grasp the upper wall part and lift the upper wall part. The lower edge 37 similarly allows vertical downward force to be applied to the upper part to bring it into a position in which the machined surfaces 46 and 47 are properly in position against the abutting surfaces of the lower wall part 31. In addition the recessed band 34 provides a stiffening effect at the joint. Furthermore the lower edge 37 provides a stop member locating the uppermost edge 33.

The recessed band 44 similarly provides a stiffening effect at the upper edge of the lower wall part. In addition the space between the lowermost edge 32 and the lower edge 45 of the recessed band provides an attractive appearance in that it matches the recessed band 34 thus providing an appearance of a double groove as shown in FIG. 1. This double groove tends to remove from vision the actual joint line provided at the lowermost edge 32.

This construction has the following advantages.

1. The unit can be installed and assembled in position without access to the back side of the structure.
2. The groove or recess 34 provides a finger grip to enable the user to assemble the sections from the inside.
3. The groove 34 stiffens or strengthens the walls at the joint line.
4. The lap joint system with the upper wall part providing the inner wall ensures a leak proof joint line.
5. The use of the double sided tape provides both the sealing of the joint line without additional sealant and provides the structural strength of the joint line without additional joining elements.

Figure 4:
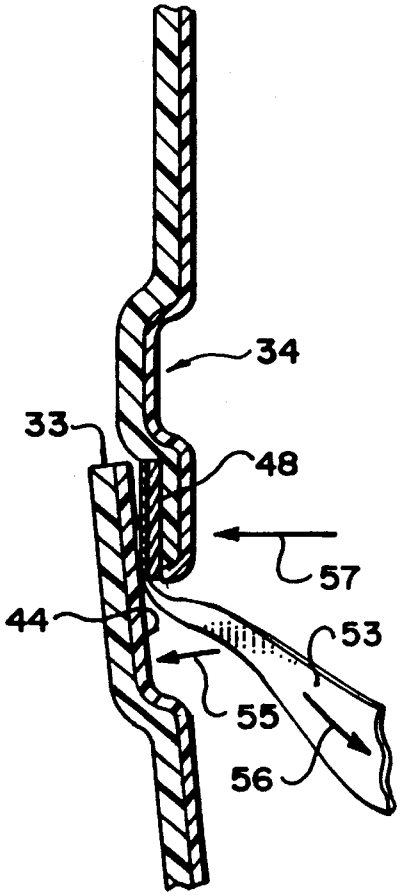
FIG. 4 is a yet further cross-sectional view similar to that of FIG. 2 showing a third step in the formation of the joint.
Figure 3:
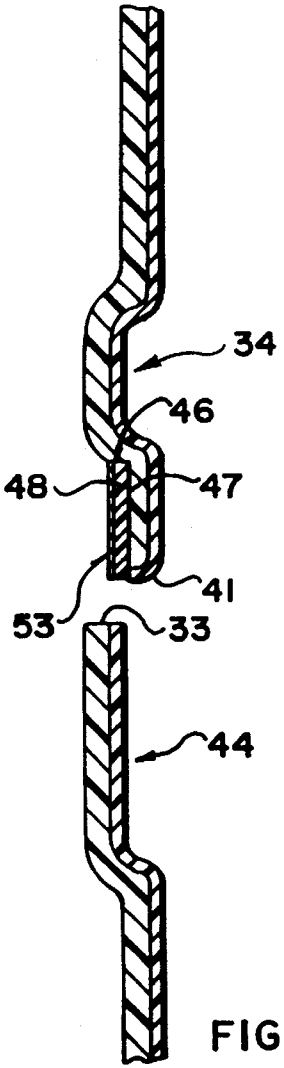
FIG. 3 is a similar cross-sectional view as that of FIG. 2 showing a next step in the formation of the joint.
Figure 2:
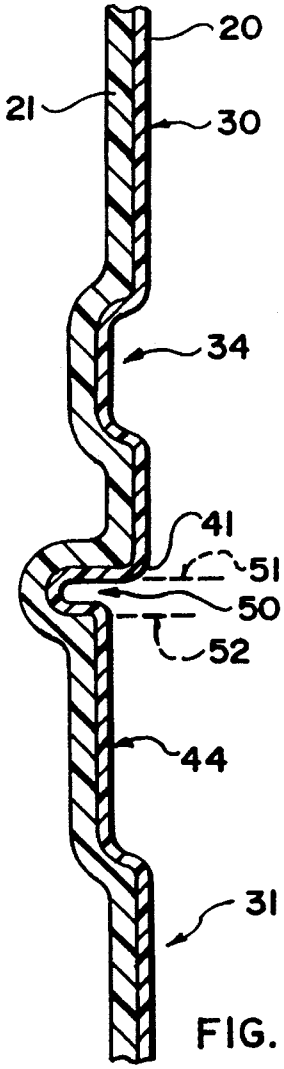
FIG. 2 a cross-sectional view through one portion of the initial structure of the tub/shower unit prior to formation of the joint.

The steps in manufacture of the joint are shown in FIGS. 2, 3, and 4. In FIG. 2 an initial construction is shown in which the bands 34 and are formed by a molding technique with the addition of a further groove 50 positioned between these bands defining a U-shape section simply as a connector piece to be removed.

In the next step, a cutting blade provides a cutting action along the lines 51 and 52 so as to remove the U-shaped groove 50. It will be noted that the cutting line 51 is positioned just below the curved wall part 41 so as to leave this outwardly curved inside layer portion in tact. The cut line 52 is however positioned slightly lower so as to cut away the outwardly curved portion at that cut line thus forming a directly horizontal blunt cut end at the uppermost edge 33.

After the cutting is complete, a machine tool in the form of a router is applied to the surfaces 46 and 47 to provide the direct right angle straight line surfaces necessary for engagement with the surfaces of the lower wall part.

The next step requires the application of the double sided adhesive tape 47 which is covered by a covering layer 53 on the surface away from the surface 47. The upper wall part can thus be assembled in engagement with the lower wall part for transportation or storage purposes without the adhesive causing a permanent bond.

The next stage in the assembly process is the final installation at the required location at which time the upper wall part and lower wall part are properly assembled after transportation to the necessary location. The user can grasp the upper wall part at the groove or recess 34 to provide upward or downward pressure to move the elements relative to one another to bring the uppermost edge 33 properly into engagement with the surface 46. At this point, one part of the covering layer 53 can be grasped and pulled so it is pulled away from its engagement with the outside surface of the tape 48. As shown in FIG. 4, slight pressure indicated by the arrow 55 at the point of pulling on the tape 53 as indicated at the arrow 56 will cause the lower wall part to distort slightly rearwardly to provide enough of a gap between the upper and lower wall part for the tape or covering layer 53 to be extracted. Once extracted, pressure on the band 38 as indicated at the arrow 57 will cause a final bonding between the adhesive tape and the inside surface of the band 44.

Figure 6:
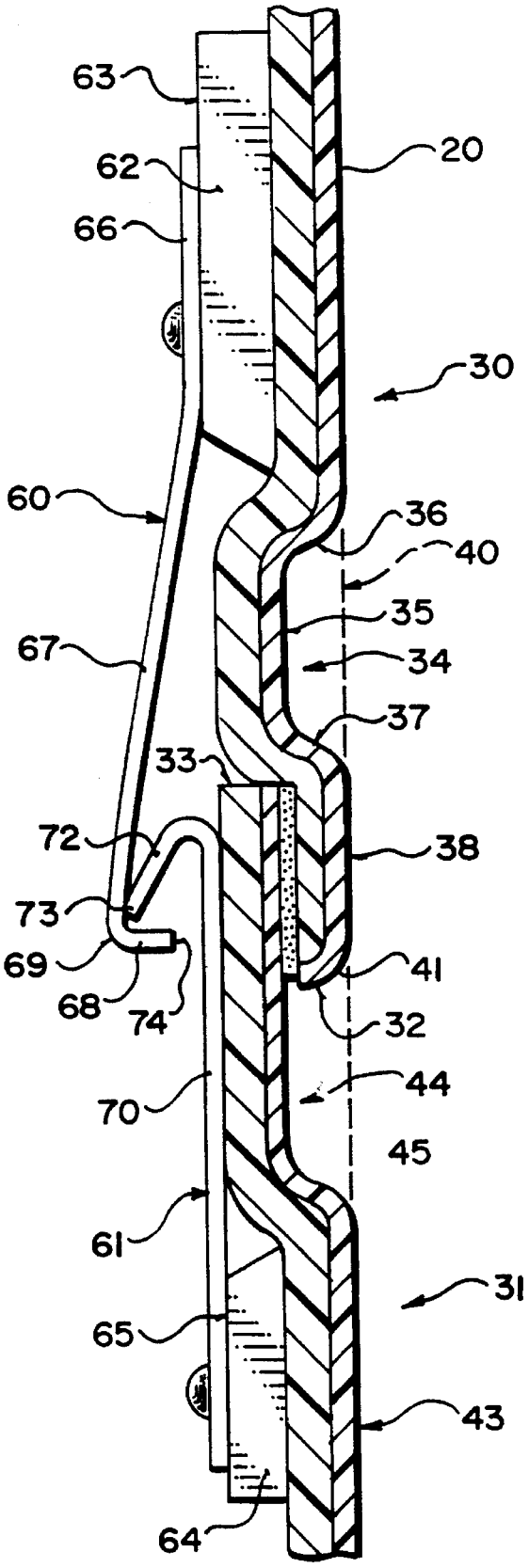
FIG. 6 a cross-sectional view similar to that of FIG. 5 showing in addition a spring clip arrangement for snapping the joint into place and for applying pressure to the adhesive tape.

Turning now to FIG. 6 there is shown an alternative arrangement in which there is provided an additional spring clip arrangement which assists in the assembly of the joint and may in addition provide structural stability after the joint is assembled. Although only one such spring clip arrangement is shown in FIG. 6. It will be appreciated that there are a number of such spring clips arranged at spaced positions along the length of each joint.

Each spring clip arrangement therefore comprises a first clip member 60 and a second clip member 61 which cooperate at the joint line. A wooden block 62 is attached to the upper wall part immediately above the upper edge of the recessed band 34 with an outer surface 63 of the wooden block substantially co-planar with the outer surface of the recess band 34. A similar wooden block 64 is attached to the lower wall part immediately underneath the recess section 45. Aga n the wooden block 64 has an outer surface 65 co-planar with the outer surface of the second band portion 44.

The spring clip member 60 includes a first portion 66 attached to the outer surface 63. From the bottom edge of the block 62, the spring clip member 60 includes a second portion 67 which is inclined downwardly and outwardly to a position beyond the joint line. At the lowermost end of the second or spring band portion 67 there is provided a portion 68 which is turned inwardly from the lowermost end 69 of the spring band portion 67.

The clip member 61 includes a first portion 70 lying flat against the outward surface 65 of the block 64 and against the outer surface of the second band portion 44. At a position just below the joint line that is the top edge 33 of the lower wall part, the second spring clip member 61 turns downwardly and outwardly to form a second portion 72 having a lower abutment end 73 spaced downwardly from the upper edge 33.

Prior to assembly of the upper and lower wall parts, the first spring member 60 is spaced upwardly above the second spring clip member 61 so that the hook portion 68 is above the abutment portion 72. When the upper wall part is pulled downwardly onto the lower wall part, an inner end 74 of the portion 68 engages the outer surface of the abutment portion 72 and slides over that outer surface until the hook portion 68 passes beyond the abutment end 73. The location of the spring clip members on the upper and lower wall parts is arranged so that the hook portion 68 passes over the abutment end 73 only when the upper wall part is fully pulled down onto the limit of the lower wall part defined by the upper edge 33. Thus when the parts are fully pulled together in the vertical direction, the hook portion 68 snaps over the abutment end 73 to hold the upper and lower wall parts together to prevent vertical movement apart. In addition the snap sound caused by the hook portion 68 engaging over the abutment end indicates to the installer (who cannot see the spring clip members) that the upper wall part has been fully pulled down to its position in the lower wall part.

In addition to the location of the parts in the vertical direction, the spring band portion 67 is spring biased in a direction toward the outer surface of the wall parts so as to provide a pushing force on the abutment end 73 tending to push the upper band 44 of the lower wall part inwardly. At the same time the upper end of the spring band 67 pulls the lower edge of the upper wall rearwardly thus squeezing the adhesive tape to further improve the curing action of the tape in bonding to the inner surface of the band 44.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A shower enclosure comprising a wall assembly including a rear wall and at least one side wall, said wall assembly being divided at a horizontal joint into an upper wall part and a lower wall part for separate transportation into an installation location and for subsequent connection together at the horizontal joint to form the complete wall assembly, each of the upper wall part and the lower wall part including a respective portion of the rear wall and of the at least one side wall, the wall assembly having an inner surface facing inwardly and forwardly and an outer surface facing outwardly and rearwardly, the lower wall part having an upper most edge at the horizontal joint and the upper wall part having a lowermost edge at the horizontal joint, and lap joint means defining a lap joint between the upper wall part and the lower wall part at the horizontal joint, said lap joint means comprising a horizontal recessed band defined in the upper wall part adjacent to but spaced from the lowermost edge thereof and having a base of the recessed band displaced outwardly and a bottom edge of the recessed band turned inwardly from the base, a first horizontal band portion of the upper wall part connected to the bottom edge of the recessed band and thus extending between the recessed band and the lowermost edge, which is displaced inwardly relative to the base of the recessed band, a portion of the upper wall part adjacent to and above the recessed band which is displaced inwardly relative to the base of the recessed band, and a second horizontal band portion of the lower wall part at the uppermost edge thereof which is displaced outwardly relative to the first horizontal band portion, the second horizontal band portion being overlapped with the first horizontal band portion to lie outwardly thereof with the uppermost edge in contact with the outer surface of the bottom edge of the recessed band.

2. The shower enclosure according to claim 1 wherein the second band portion is recessed outwardly relative to an adjacent main body portion of the lower wall part.

3. The shower enclosure according to claim 2 wherein the inside surface of the main body portion of the lower wall part lies in the same vertical plane as said portion of the upper wall part.

4. The shower enclosure according to claim 2 wherein the second band portion has a vertical height greater than that of the first band portion.

5. The shower enclosure according to claim 4 wherein the second band portion has a vertical height greater than that of the first band portion by a distance substantially equal to the vertical height of the recessed band.

6. The shower enclosure according to claim 1 including sealing means between said outer surface of the first horizontal band portion and the inner surface of the second horizontal band portion, said sealing means comprising a double sided tape carried on either the outer surface of the first band portion or the inner surface of the second band portion, the double sided tape having a covering layer on an exposed surface thereof, the covering layer being removable between the outer surface of the first band portion and the inner surface of the second band portion subsequent to the mounting of the upper wall part on the lower wall part.

7. The shower enclosure according to claim 6 wherein the double sided tape is carried on the outer surface of the first band portion.

8. The shower enclosure according to claim 1 wherein the outer surface of the first band portion and the outer surface of the bottom edge of the recessed band are cut by a machining tool to form a right angle for receiving the uppermost edge therein.

9. The shower enclosure according to claim 1 wherein the lowermost edge includes an inner surface which is curved convexly so the inner surface extends from the first band portion around the lowermost edge to a position closely adjacent the inner surface of the second band portion.

10. A shower enclosure comprising a wall assembly including a rear wall and at least one side wall, said wall assembly being divided at a horizontal joint into an upper wall part and a lower wall part for separate transportation into an installation location and for subsequent connection together at the horizontal joint to form the complete wall assembly, each of the upper wall part and the lower wall part including a respective portion of the rear wall and of the at least one side wall, the wall assembly having an inner surface facing inwardly and forwardly and an outer surface facing outwardly and rearwardly, the lower wall part having an uppermost edge at the horizontal joint and the upper wall having a lowermost edge at the horizontal joint, the upper wall part and the lower wall part each having a respective vertical extent above and below the horizontal joint respectively with the vertical extents lying in a common vertical plane, and lap joint means defining a lap joint between the upper wall part and the lower wall part at the horizontal joint, said lap joint means comprising a first horizontal band portion of the upper wall part at the lowermost edge, a second horizontal band portion of the lower wall part at the uppermost edge which is displaced outwardly relative to the first horizontal band portion, the second horizontal band portion being overlapped with the first horizontal band portion to lie outwardly thereof, the upper wall part on the outer surface thereof at a top of the first horizontal band portion being shaped to define a recess having a substantially horizontal surface against which the uppermost edge of the lower wall part engages to limit upward movement of the lower wall part relative to the upper wall part, the vertical length of the first horizontal band portion being less than that of the second horizontal band portion such that a part of the second horizontal band portion is exposed below the lowermost edge, the first and second horizontal band portions lying in vertical planes arranged such that neither the first nor the second band portion lies inwardly of the common vertical plane of the vertical extents.

11. The shower enclosure according to claim 10 including sealing means between said outer surface of the first horizontal band portion and the inner surface of the second horizontal band portion, said sealing means comprising a double sided tape carried on either the outer surface of the first band portion or the inner surface of the second band portion, the double sided tape having a covering layer on an exposed surface thereof, the covering layer being removable between the outer surface of the first band portion and the inner surface of the second band portion subsequent to the mounting of the upper wall part on the lower wall part.

12. The shower enclosure according to claim 11 wherein the double sided tape is carried on the outer surface of the first band portion.

13. The shower enclosure according to claim 10 wherein the recess is cut by a machining tool to form a right angle for receiving the uppermost edge therein.

14. The shower enclosure according to claim 10 wherein the lowermost edge includes an inner surface which is curved convexly so the inner surface extends from the first band portion around the lowermost edge to a position closely adjacent the inner surface of the second band portion.

15. A shower enclosure comprising a wall assembly including a rear wall and at least one side wall, said wall assembly being divided at a horizontal joint into an upper wall part and a lower wall part for separate transportation into an installation location and for subsequent connection together at the horizontal joint to form the complete wall assembly, each of the upper wall part and the lower wall part including a respective portion of the rear wall and of the at least one side wall, the wall assembly having an inner surface facing inwardly and forwardly and an outer surface facing outwardly and rearwardly, the lower wall part having an upper most edge at the horizontal joint and the upper wall part having a lowermost edge at the horizontal joint, lap joint means defining a lap joint between the upper wall part and the lower wall part at the horizontal joint including limit means for limiting vertical movement of the wall parts toward one another to a predetermined extent of overlap thereof, and a spring clip arrangement for holding the upper wall part and the lower wall part in the lap joint, the spring clip arrangement comprising a first clip member mounted on the outer surface of either the upper wall part or the lower wall part, and a second clip member mounted on the outer surface of the other of the upper and lower wall parts, the first clip member defining an abutment projecting outwardly of the wall parts, the second clip member having a hook portion shaped to pass over the abutment as the wall parts are moved vertically toward one another and to engage over the abutment when the wall parts reach said limit means to hold the wall parts against movement vertically apart.

16. The shower enclosure according to claim 15 wherein the second clip member comprises a spring blade for applying force to the first clip member in a direction to press the lap joint together in a horizontal direction.

17. The shower enclosure according to claim 16 where the spring blade is inclined from said other of the wall parts outwardly with said hook portion at an end of the spring blade.

18. The shower enclosure according to claim 15 wherein said lap joint means comprises a horizontal recessed band defined in the upper wall part adjacent to but spaced from the lowermost edge thereof and having a base of the recessed band displaced outwardly and a bottom edge of the recessed band turned inwardly from the base, a first horizontal band portion of the upper wall part connected to the bottom edge of the recessed band and thus extending between the recessed band and the lowermost edge, which is displaced inwardly relative to the base of the recessed band, a portion of the upper wall part adjacent to and above the recessed band which is displaced inwardly relative to the base of the recessed band, and a second horizontal band portion of the lower wall part at the uppermost edge thereof which is displaced outwardly relative to the first horizontal band portion, the second horizontal band portion being overlapped with the first horizontal band portion to lie outwardly thereof, said limit means comprising the uppermost edge which lies in contact with the outer surface of the bottom edge of the recessed band.

19. The shower enclosure according to claim 15 wherein the upper wall part and the lower wall part each have a respective vertical extent above and below the horizontal joint respectively with the vertical extents lying in a common vertical plane, and wherein said lap joint means comprises a first horizontal band portion of the upper wall part at the lowermost edge, a second horizontal band portion of the lower wall part at the uppermost edge which is displaced outwardly relative to the first horizontal band portion, the second horizontal band portion being overlapped with the first horizontal band portion to as to lie outwardly thereof, the limit means comprising a recess defined on the upper wall part on the outer surface thereof at a top of the first horizontal band portion having a substantially horizontal surface against which the uppermost edge of the lower wall part engages to limit upward movement of the lower wall part relative to the upper wall part, the vertical length of the first horizontal band portion being less than that of the second horizontal band portion such that a part of the second horizontal band portion is exposed below the lowermost edge, the first and second horizontal band portions lying in vertical planes arranged such that neither the first nor the second band portion lies inwardly of the common vertical plane of the vertical extents.

20. A method of assembling a shower enclosure comprising providing a wall assembly including a rear wall and at least one side wall, dividing said wall assembly at a horizontal joint into an upper wall part and a lower wall part for separate transportation into an installation location and for subsequent connection together at the horizontal joint to form the complete wall assembly, each of the upper wall part and the lower wall part including a respective portion of the rear wall and of the at least one side wall, the wall assembly having an inner surface facing inwardly and forwardly and an outer surface facing outwardly and rearwardly, the lower wall part having an uppermost edge at the horizontal joint and the upper wall part having a lowermost edge at the horizontal joint, and providing a lap joint between the upper wall part and the lower wall part at the horizontal joint including defining a first horizontal band portion of one of the wall parts at the edge thereof, defining a second horizontal band portion of the other of the wall parts at the edge thereof, locating the first horizontal band portion displaced outwardly relative to the second horizontal band portion, overlapping said first horizontal band portion with the second horizontal band portion to lie outwardly thereof with an inner surface of said first horizontal band portion adjacent an outer surface of said second horizontal band portion, limiting upward movement of the lower wall part relative to the upper wall part, providing a double sided adhesive tape on one of the inner surface of the first horizontal band portion and the outer surface of the second horizontal band portion so as to be carried thereby, the tape having a protective layer thereon, and after overlapping the first and second horizontal band portions, pulling the protective layer from the tape through a space between the horizontal band portions inwardly of the lap joint.

21. The method according to claim 20 wherein said first horizontal band portion is attached to the lower wall part, wherein the second horizontal band portion is attached to the upper wall part and wherein the vertical length of the first horizontal band portion is less than that of the second horizontal band portion such that a part of the second horizontal band portion is exposed below the lowermost edge.

22. The method according to claim 21 including pushing the first horizontal band portion outwardly to increase the space between the first and second band portions to release said protective layer.

23. The method according to claim 20 including providing a spring clip arrangement for holding the upper wall part and the lower wall part in the lap joint comprising mounting a first clip member on the outer surface of one of the upper and lower wall parts, mounting a second clip member on the outer surface of the other of the upper and lower wall parts, the first clip member defining an abutment projecting outwardly of the wall parts, the second clip member having a hook portion, passing the hook portion over the abutment as the wall parts are moved vertically toward one another and engaging the hook portion over the abutment when the wall parts reach said limit to hold the wall parts against movement vertically apart.

24. The method according to claim 23 wherein the second clip member comprises a spring blade for applying force to the first clip member in a direction to press the lap joint together in a horizontal direction.

* * * * *